United States Patent [19]

Eiermann

[11] 4,150,926

[45] Apr. 24, 1979

[54] ROTARY PISTON COMPRESSOR WITH TRANSFER FLOW POCKETS IN HOUSING

[75] Inventor: Dankwart Eiermann, Lindau, Fed. Rep. of Germany

[73] Assignees: Borsig GmbH; Wankel GmbH, both of Berlin, Fed. Rep. of Germany

[21] Appl. No.: 867,771

[22] Filed: Jan. 9, 1978

[30] Foreign Application Priority Data

Jan. 10, 1977 [DE] Fed. Rep. of Germany ..... 2700731

[51] Int. Cl.[2] ..... F04C 17/02; F04C 29/00

[52] U.S. Cl. ..... 418/61 A; 418/75; 418/142

[58] Field of Search ..... 418/61 A, 75, 78, 79, 418/142, 180

[56] References Cited

U.S. PATENT DOCUMENTS

| | | | |
|---|---|---|---|
| 3,881,847 | 5/1975 | Chen | 418/61 A |
| 3,883,273 | 5/1975 | King | 418/61 A |
| 4,018,548 | 4/1977 | Berkowitz | 418/61 A |
| 4,047,856 | 9/1977 | Hoffman | 418/61 A |

FOREIGN PATENT DOCUMENTS

| | | | |
|---|---|---|---|
| 2127546 | 12/1972 | Fed. Rep. of Germany | 418/61 A |

*Primary Examiner*—John J. Vrablik
*Attorney, Agent, or Firm*—Walter Becker

[57] ABSTRACT

The specification describes a rotary piston compressor with a double-arcuate trochoidal casing track, with which a triangular piston, rotating on an eccentric shaft, makes constant sliding contact at its corners. Transfer flow pockets are provided via which the following working chamber already shuts off, and in the vicinity of the dead center position, is connected for a short time with the compression chamber coming in front of it. The transfer flow recesses are provided in at least one side part of the compressor, extend under its housing casing and extend so far inwards radially in its side wall that they are not swept by the sealing strip. Their timing edge, lying to the fore in the direction of rotation of the piston, is determined by the position of the preceding piston corner of the chamber located in the dead center position. Their timing edge, which is to the rear in the direction of rotation of the piston, is determined by the position of the same piston corner at the time of uncovering the inlet port following this preceding chamber.

4 Claims, 2 Drawing Figures

ROTARY PISTON COMPRESSOR WITH TRANSFER FLOW POCKETS IN HOUSING

BACKGROUND OF THE INVENTION

1. Field of the Invention Relates

The invention relates to a planetary rotation piston compressor with a double-arcuate trochoidal casing track, with which a triangular piston, rotating on an eccentric shaft makes constant sliding contact at its corners, and in the housing of the compressor transfer flow pockets are provided, via which a given following working chamber, already shut off and in the vicinity of the dead center position, is connected for a short time with the compression chamber coming in front of it. Such compressors are intended especially for use in refrigeration circuits, air pressure bracking systems or as compressors in pneumatic power systems in vehicles. More particularly in the two last mentioned cases there is the requirement for the pumping of large volumes of air at a high pressure of for example up to 10 bar. Furthermore all applications require very smooth running and in this respect it is necessary to avoid the occurrence of negative torque.

2. The Prior Art

Such a negative torque arises when the compression chamber is shut off after termination of the expulsion stroke and has therefore beyond its dead center position. This negative torque leads not only to noisy running but can also even lead to breakage of the shaft owing to the build-up of torsion vibrations in the shaft.

In the German specification (Offenlegungsschrift) No. 2,402,084 these conditions are described in detail in the case of an analogous machine with a piston having two corners and a single-arcuate trochoidal track. There is a proposal in this specification to arrange the inlet and outlet ports with the distance of the longitudinal axis of the piston in order to ensure that, on passing over one of these timing ports, the pressure in the compression chamber, which has already been shut off in the vicinity of the dead center position, is relieved via these ports into the following or preceding chamber. This proposal for avoiding negative torque cannot be directly applied to the machine of the present invention having a triangular piston and a dual-arcuate casing track.

The residual volume of the working medium, which cannot be expelled owing to the unavoidable dead space of such a machine, is under a high pressure and has disadvantageous effect along the lines indicated, leads to the throughput of the machine being limited.

In accordance with the proposal of the German specification (Offenlegungsschrift) No. 2,127,546 transfer flow pockets are to be milled into the casing track in the vicinity of the piston corner delimiting the compression chamber which is being shut off and via these pockets the working medium enclosed in this chamber can partly flow into the preceding compression chamber, which, although it is also shut off, is under a lower pressure. These transfer flow pockets are to be arranged in the axial direction adjacent to each other and lands have to be left between them extending as far as the surface of the casing track in order to prevent the sealing elements of the piston corners falling into the pockets or fouling them. The pockets are therefore specifically limited in their axial extent. Furthermore in their extent in the direction of piston movement a limitation is also necessary, this limitation being due to the uncovering of the inlet port leading towards the following chamber, which then becomes the induction chamber, on further rotation of the piston. This measure is, however, not sufficient to draw off the volume of the working medium, trapped in the dead center space of the piston, into the preceding chamber, if the displacements and pressures required for the types of machines specified are to be ensured and the violent beating action, occurring at high speeds of rotation, is to be avoided which is due to negative torques, as detailed testing carried out by us has shown. This applies more especially at high speeds of rotation.

The previously proposed transfer flow pockets can furthermore only be produced at considerably expense, since milling must be carried out in the interior of the housing casing or, the transfer flow pockets lead to re-entrant mold parts. Furthermore a coating of the track, which is necessary in the case of light alloy housings, is interrupted by such recesses repeatedly in a direction perpendicular to the movement of the piston, this leading to the danger of detachment.

SHORT SUMMARY OF THE INVENTION

One aim of the invention is therefore that of obtaining a sufficient transfer of the working medium trapped in the dead center position of the piston, into the preceding working chamber and obtaining a complete pressure equilisation even in the case of high speeds of rotation and high pressures. Furthermore the occurrence of negative torques is to be completely avoided.

The way in which these and other aims are achieved is indicated in the claims.

LIST OF THE FIGURES OF THE DRAWINGS

One embodiment of the invention will now be described in what follows with reference to the accompanying drawing showing it.

DESCRIPTION OF EMBODIMENTS OF THE INVENTION

Figure 1:
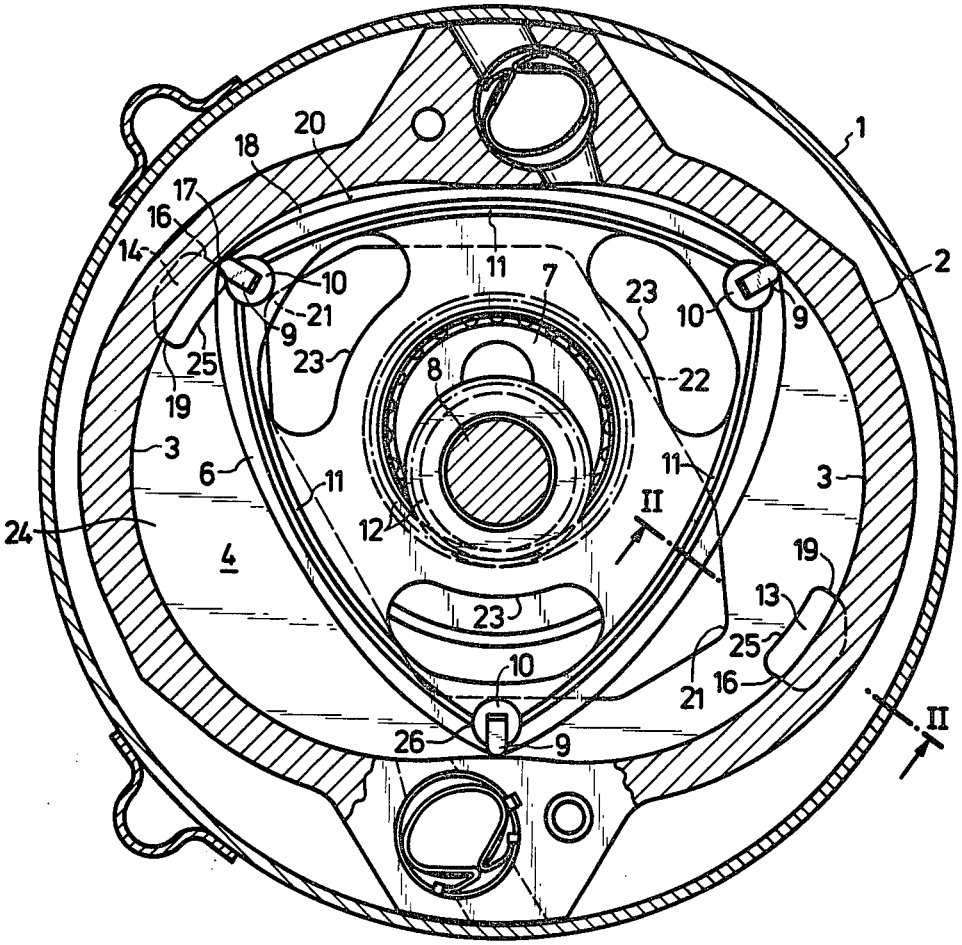
FIG. 1 is a radial section through a planetary rotation piston compressor embodying the invention.
Figure 2:
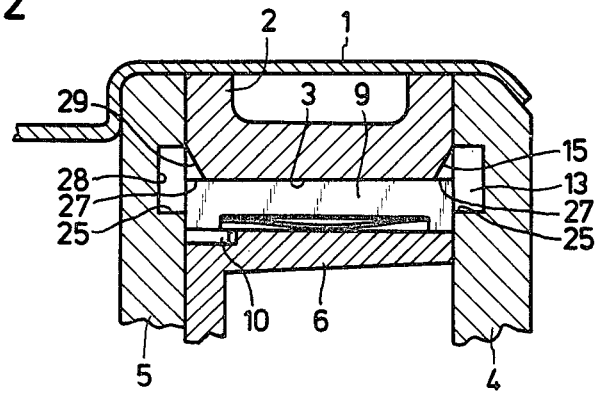
FIG. 2 is a fragmentary axial section taken along the line II — II in FIG. 1 with one piston corner being located in the plane of the section.

The compressor shown in the drawing is as to its general features described in my co-pending U.S. application Ser. No. 867,770 filed of even date herewith. The said compressor has a capsule housing 1 and a housing which consists of a housing casing 2 with a dual-arcuate trochoidal casing track 3 and two side parts 4 and 5, of which the side part denoted 4 is visible in FIG. 1 and the side part 5 (see FIG. 2) has the inlet port. A three-cornered piston 6 rotates in the housing on an eccentric 7, whose shaft is referenced 8 and extends through the side parts 4 and 5. At the corner of the piston 6 sealing elements are provided which consist of sealing strips 9 and sealing pins 10. Furthermore, at the lateral edges of the piston, sealing strips 11 are provided which have their ends lying against the sealing pins 10. The sealing strips 9 ensure continuous sliding engagement of the piston 6 with the casing track 3. The movement of the piston 6 is produced by the gear wheel drive 12. In the side part 4 shown in FIG. 1 two pocket-like recesses 13 and 14 are provided following (that is to say in terms of the direction of rotation of the piston 6) the dead center position on the one hand and approximately at the beginning of the second third of the respective following arc of the casing track 3 on the other hand. These recesses 13 and 14 extend, as is shown by FIG. 2, for approximately half of their radial extent under the housing casing 2. On the housing casing 2 it is possible to provide, as is indicated in FIG. 2, oblique surfaces 15 adjacent to the recesses 13 and 14 leading into them.

The position of these recesses 13 and 14 is determined by the following factors: The control edge 16, which is to the fore, in the direction of rotation of the piston 6, of these recesses lies directly ahead of the preceding piston corner 17 of the chamber 18 which is in the dead center position, as will be seen in FIG. 1. The position of the timing edges 19, which are to the rear in the direction of rotation of the piston 6, of the recesses 13 and 14 is determined by the same piston corner for the position of the piston 6, in which its edge 20 is uncovering the inlet port 21 for the above mentioned chamber 18 and the chamber 18 therefore becomes the induction chamber. The inlet ports are, in the case of the compressor shown in FIG. 1, the corners of a pocket-shaped recess 22 in the side part 5, which via the openings 23 in the piston 6 are supplied with working medium entering through the other side part 4.

The position described of the front control edge 16 of the recesses 13 and 14, acting as transfer flow pockets, results from the piston at that point in time, in which the pressure, bringing about the negative torque, in the chamber 18 exceeds the total frictional resistance components of the machine, that is to say shortly after the piston has turned through the dead center position. The conditions for the position described of the rear control edge are known. The shutting of the recesses 13 and 14 is to take place at the latest when the inlet port of the following chamber 18 is uncovered, because in this case on any further leaving of the recesses 13 and 14 in the uncovered condition, the preceding compression chamber 24 would be connected with this inlet port 21.

It was also described in the German Offenlegungsschrift No. 2,127,546 that more particularly in the case of high speeds of rotation only a very short time is available for the transfer of the gases, under a relatively high pressure, into the preceding chamber 24. In order to make use of this time available and to be able to produce complete pressure equalisation between the chambers 18 and 24, the recesses 13 and 14 must be as large as possible, something which is certainly possible in the side parts 4 and 5 in contrast to an arrangement of transfer flow pockets in the casing track. The recesses can be extended in a radially inner direction to the full extent allowed by the position of sealing elements at the piston corners. This limitation 25 of the radial extent of the recesses 13 and 14 is therefore determined by the radial position of the end 26 of the sealing strip 11, which follows the piston corner 16 passing over the recess. This end must not be permitted to knock against the rear control edge 19 of the recesses 13 and 14. In order to enlarge the transfer flow path via the recesses 13 and 14 the corner seals 9, 10 and 11 of the piston 6 can be offset radially inwards as is described in detail in the German Offenlegungsschrift No. 2,232,997.

In order to improve the flow capacity of the recesses 13 and 14 it is possible, as indicated in FIG. 2, to provide the oblique surfaces 15 on the casing track, which are only limited in an axial direction when the sealing strips 9 are divided in order to ensure that the corner parts of such strips do not knock against the rear control edges 27 of these oblique surfaces.

It is clear that the pocket-like recesses 13 and 14 can be arranged on the two side parts, as is indicated in FIG. 2 at 27 and 28 and that similarly the oblique surface on the casing part 2 can also be provided on the side of the side part 5, as is indicated at 29.

A particular advantage of this arrangement of the recesses 13 and 14 in the side parts is that they can be provided in the latter even on casting and therefore they do not give rise to any manufacturing difficulties or extra expense on assembly. Furthermore the oblique surfaces in the housing casing 2 can be produced on it by casting and do not give rise to any difficulties in this respect, since they do not lead to any re-entrant parts in the mould.

Detailed tests carried out by me with compressors in accordance with the invention have shown that owing to the arrangement of the recesses 13, 14, 15, 27 and 29 described, it is possible to achieve a substantial increase in the delivery and pressure and that this advantage will also be retained when operating at high speeds of rotation. The measures proposed are therefore sufficient to ensure that in all cases of application the gases under pressure trapped in the chamber 18 are transferred into the preceding compression chamber 24 until pressure equalization takes place, thereby avoiding the disadvantages formation of a dead space in such machines. Furthermore the arrangement in accordance with the invention prevents the occurrence of negative torques, something which leads to satisfactory running properties.

It is of course to be understood that the present invention is, by no means, limited to the specific showing in the drawing but also encompasses any modification within the scope of the appended claims.

What I claim is:

1. A rotary piston compressor which includes: a housing having two side portions each one of which is provided with transfer flow pockets, said housing also having an intermediate portion arranged between said side portions and having its inner surface designed as a double-arcuate trochoidal raceway, an eccentric shaft rotatably journalled in said compressor, a triangular piston rotatably mounted on said eccentric shaft and having its corners in continuous sliding contact with said raceway, said piston having its lateral rim portions provided with sealing strips while with said side portions and said intermediate portion forming working chambers and compression chambers, inlet and outlet ports in said housing for said chambers, said transfer flow pockets extending radially inwardly to such an extent only as not to be swept by said sealing strips, when looking in the direction of rotation of said piston the front control edge of said transfer flow pockets being determined by the location of the leading piston corner of that chamber which occupies its dead center position whereas the rear control edge of said transfer flow pockets is determined by the location of said same leading corner at the time of uncovering the inlet port toward the preceding chamber.

2. A compressor according to claim 1, in which in the vicinity of said transfer flow pockets in said side portions oblique surfaces are provided in said intermediate portion for increasing the size of the openings of said transfer flow pockets.

3. A compressor according to claim 1, in which said transfer flow pockets represent cast portions.

4. A compressor according to claim 2, in which said oblique surfaces represent cast sections.

* * * * *